US012421462B2

(12) United States Patent
Jeon et al.

(10) Patent No.: US 12,421,462 B2
(45) **Date of Patent: *Sep. 23, 2025**

(54) LUBE BASE OIL MANUFACTURING PROCESS UTILIZING REFINED OIL FRACTION OF WASTE LUBRICANT, AND LUBE BASE OIL MANUFACTURED THEREBY

(71) Applicants: SK INNOVATION CO., LTD., Seoul (KR); SK ENMOVE CO., LTD., Seoul (KR)

(72) Inventors: Young Wook Jeon, Daejeon (KR); Jun Soo Park, Daejeon (KR); Eun Kyoung Kim, Daejeon (KR); Kyung Seok Noh, Daejeon (KR)

(73) Assignees: SK INNOVATION CO., LTD., Seoul (KR); SK ENMOVE CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/611,720

(22) Filed: Mar. 21, 2024

(65) Prior Publication Data

US 2025/0026992 A1 Jan. 23, 2025

(30) Foreign Application Priority Data

Jul. 18, 2023 (KR) ..... 10-2023-0093261

(51) Int. Cl.
*C10G 53/04* (2006.01)
*C10M 101/02* (2006.01)
(Continued)

(52) U.S. Cl.
CPC ..... *C10G 53/04* (2013.01); *C10M 101/02* (2013.01); *C10M 175/0033* (2013.01);
(Continued)

(58) Field of Classification Search
CPC ..... C10G 53/04; C10G 2300/1007; C10G 2300/301; C10G 2300/302;
(Continued)

(56) References Cited

U.S. PATENT DOCUMENTS 5,580,442 A 12/1996 Kwon et al.
2014/0357825 A1* 12/2014 Volker ..... F04D 29/06 508/591
(Continued)

FOREIGN PATENT DOCUMENTS

KR 10-1996-0013606 B1 10/1996
KR 10-2049750 B1 11/2019
KR 10-2442618 B1 9/2022

OTHER PUBLICATIONS

Extended European Search Report for European Patent Application No. 24164031.7 issued by the European Patent Office on Sep. 3, 2024.

*Primary Examiner* — Prem C Singh
*Assistant Examiner* — Francis C Campanell
(74) *Attorney, Agent, or Firm* — IP & T GROUP LLP

(57) ABSTRACT

A method of recycling waste lubricant. The method includes providing a waste lubricant-derived oil fraction, pretreating the waste lubricant-derived oil fraction, and hydrocracking the pretreated waste lubricant-derived oil fraction. The method has economic advantages in that waste lubricant can be recycled into fuel oil and high-grade lube base oil with a relatively high yield compared to a lube base oil manufacturing process utilizing only unconverted oil as a feedstock.

16 Claims, 2 Drawing Sheets

(51) Int. Cl.

| | |
|---|---|
| ***C10M 175/00*** | (2006.01) |
| ***C10M 177/00*** | (2006.01) |
| *C10N 30/00* | (2006.01) |
| *C10N 30/02* | (2006.01) |
| *C10N 30/20* | (2006.01) |
| *C10N 70/00* | (2006.01) |

(52) U.S. Cl.
CPC .. *C10M 175/005* (2013.01); *C10M 175/0058* (2013.01); *C10M 177/00* (2013.01); *C10G 2300/1007* (2013.01); *C10M 2203/1006* (2013.01); *C10N 2030/02* (2013.01); *C10N 2030/20* (2013.01); *C10N 2030/41* (2020.05); *C10N 2030/43* (2020.05); *C10N 2070/00* (2013.01)

(58) Field of Classification Search
CPC ..... C10G 2400/10; C10G 7/06; C10G 21/12; C10G 31/10; C10G 47/00; C10G 71/00; C10G 45/58; C10G 45/64; C10G 73/02; C10M 101/02; C10M 175/0033; C10M 175/005; C10M 175/0058; C10M 177/00; C10M 2203/1006; C10M 175/00; C10M 171/02; C10N 2030/02; C10N 2030/20; C10N 2030/41; C10N 2030/43; C10N 2070/00
USPC ..... 208/18
See application file for complete search history.

(56) References Cited

U.S. PATENT DOCUMENTS

| | | | | |
|---|---|---|---|---|
| 2017/0283734 | A1* | 10/2017 | MacDonald | B01D 3/10 |
| 2019/0016973 | A1 | 1/2019 | Murray | |
| 2019/0338204 | A1* | 11/2019 | Calla | C10M 101/02 |
| 2021/0087477 | A1* | 3/2021 | Lee | C10G 67/14 |
| 2023/0054666 | A1 | 2/2023 | Jeon et al. | |

* cited by examiner

LUBE BASE OIL MANUFACTURING PROCESS UTILIZING REFINED OIL FRACTION OF WASTE LUBRICANT, AND LUBE BASE OIL MANUFACTURED THEREBY

CROSS REFERENCE TO RELATED APPLICATION

The present application claims priority to Korean Patent Application No. 10-2023-0093261, filed Jul. 18, 2023, the entire contents of which are incorporated herein for all purposes.

BACKGROUND OF THE DISCLOSURE

1. Field of the Disclosure

Embodiments of the present disclosure relate to a lube base oil manufacturing process utilizing refined oil obtained by recycling waste lubricant and a lube base oil manufactured thereby.

2. Description of the Related Art

In the past, waste lubricant underwent a series of refining processes to obtain refined oil. The entire amount of the refined oil was used as fuel oil in Korea. However, in overseas countries, a portion of the refined oil was used as fuel oil, and the remainder was used as low-grade regenerated base oil.

Typically, waste lubricant contains additives, which contain large amounts of impurities such as sulfur (at a concentration of about 1000 to 5000 ppm), nitrogen (at a concentration of about 500 to 5000 ppm) and chlorine (at a concentration of about 100 to 5000 ppm). When waste lubricant is refined and used as fuel oil, there are problems in that the fuel oil causes environmental pollution during combustion thereof, and the fuel oil is economically disadvantageous due to a low density and calorific value thereof.

On the other hand, good lube base oils have a high viscosity index, high stability (resistant to oxidation, heat, UV, etc.), and low volatility. The American Petroleum Institute (API) classifies lube base oils according to their quality as shown in Table 1 below.

TABLE 1

| Group | Content of sulfur (ppm) | | Saturation (%) | Viscosity index (VI) |
|---|---|---|---|---|
| I | >300 | and/or | <90 | 80-120 |
| II | ≤300 | and | ≥90 | 80-120 |
| III | ≤300 | and | ≥90 | >120 |
| IV | All Polyalphaolefins (PAOs) | | | |
| V | All stocks not in Groups I-IV | | | |

In the above classification, the quality of lube base oils increases from Group I to V, of which Group III lube base oils are generally produced by advanced hydrocracking reactions. Typically, unconverted oil, which is a heavy oil that remains from a fuel oil hydrocracking process and which has not been converted to fuel oil, is used as a feedstock for the production of advanced lube base oils of Group III or higher, and a method for the production of advanced lube base oils using unconverted oil as a feedstock is disclosed in Korean Patent No. 1996-0013606, etc.

SUMMARY OF THE DISCLOSURE

Embodiments of the present disclosure relate to a lube base oil manufacturing process utilizing refined oil obtained through waste lubricant recycling and a lube base oil manufactured thereby.

According to an embodiment of the present disclosure, there is provided a lube base oil manufacturing process utilizing a refined oil fraction obtained from waste lubricant, the process including: providing a refined oil fraction by refining waste lubricant; pretreating the refined oil fraction, in which the refined oil fraction has a nitrogen content of less than 30 ppm; and blending the pretreated refined oil fraction with unconverted oil (UCO) before or after subjecting the unconverted oil to vacuum distillation and catalytic dewaxing or between the vacuum distillation and the catalytic dewaxing of the unconverted oil.

According to an embodiment of the present disclosure, the refined oil fraction may be produced by: subjecting a waste lubricant to a centrifugation operation for separating and removing solid impurities present in the waste lubricant and producing a purified waste lubricant; performing an atmospheric distillation on the purified waste lubricant for separating the purified waste lubricant in a plurality of fractions according to their boiling point; and performing a first vacuum distillation; to a fraction obtained from the atmospheric distillation operation having a boiling point of about 150° C. or higher, and collecting an oil fraction having a boiling point of 300° C. to 550° C.

According to an embodiment, an oil fraction obtained from the atmospheric distillation operation having a boiling point lower than 150° C. is used as a fuel oil.

According to an embodiment, the pretreating may include performing solvent extraction on the refined oil fraction.

According to an embodiment, a solvent used for the solvent extraction may be selected from the group consisting of N-methyl-2-pyrrolidone, sulfolane, DMSO, furfural, phenol, acetone, and combinations thereof.

According to an embodiment, the solvent extraction may be performed at a temperature in a range of 50° C. to 150° C. and a pressure in a range of the atmospheric pressure to 5 $kg/cm^2$.

According to an embodiment, the solvent extraction may be performed under a solvent to oil volume ratio of 1:1 to 10:1.

According to an embodiment, the vacuum distillation may be performed before the catalytic dewaxing.

According to an embodiment, the catalytic dewaxing may be performed in the presence of a catalyst including an EU-2 zeolite carrier.

According to an embodiment, the blending amount of the refined oil fraction with respect to the unconverted oil may be 1% by volume or more and 10% by volume or less of the mixture in which the refined oil fraction and the unconverted oil are blended.

According to an embodiment, the mixture in which the refined oil fraction and the unconverted oil are blended may have a sulfur content of less than 50 ppm, a nitrogen content of less than 10 ppm, and a chlorine content of less than 2 ppm.

According to an embodiment of the present disclosure, there is provided a lube base oil manufactured by the aforementioned manufacturing process, in which the lube base oil may have a viscosity index of 120 or more and a saturation degree of 90% or more.

According to an embodiment, the lube base oil may have a Saybolt color value of 27 or more.

According to an embodiment, the lube base oil may have a saturation degree of 99% or more.

According to an embodiment, the content of each of sulfur, nitrogen, and chlorine in the lube base oil may be lower than 1 ppm.

According to an embodiment, there is provided a lube base oil manufacturing process utilizing refined oil regenerated from waste lubricant, the process comprising: subjecting a waste lubricant to a centrifugation operation for separating and removing solid impurities present in the waste lubricant and producing a purified waste lubricant; performing an atmospheric distillation on the purified waste lubricant for separating the purified waste lubricant in a plurality of fractions according to their boiling point; and performing a first vacuum distillation to a fraction obtained from the atmospheric distillation operation having a boiling point of about 150° C. or higher; collecting a refined oil fraction having a boiling point of 300° C. to 550° C.; pretreating the refined oil fraction, wherein the pretreated refined oil fraction has a nitrogen content of less than 30 ppm; blending the pretreated refined oil fraction with unconverted oil to form a mixture; subjecting the mixture to vacuum distillation and catalytic dewaxing to produce lube base oils.

According to embodiments of the present disclosure, the lube base oil manufacturing process utilizing a refined oil fraction recycled from waste lubricant, recycle the waste lubricant as high-quality lube base oil rather than fuel oil. Therefore, it is possible to recycle waste lubricant economically and in an eco-friendly manner. In addition, a refined oil fraction obtained by refining waste lubricant is blended with unconverted oil, and then the mixture is subjected to catalytic dewaxing. Here, the refined oil fraction (or waste lubricant) contains little or substantially no wax component. Therefore, the manufacturing process of the present disclosure makes it possible to produce a lube base oil with a relatively high yield compared to a lube base oil manufacturing process utilizing only unconverted oil as a feedstock.

DETAILED DESCRIPTION

As used herein, the term "unconverted oil (UCO)" refers to a heavy cycle oil remaining without being converted to fuel oil through a fuel oil hydrocracking process.

As used herein, the term "waste lubricant" refers to used lubricant. In general, lubricant contains a lube base oil and various additives. The additives contain large amounts of impurities that are not suitable for use in a lube base oil. Waste lubricant contains large amounts of impurities. For example, waste lubricant may contain 1000 to 5000 ppm of sulfur, 500 to 5000 ppm of nitrogen, 100 to 5000 ppm of chlorine, and other metallic impurities that may be introduced during lubrication. In addition, the waste lubricant may have a specific gravity of 0.8 to 0.9, a kinematic viscosity (at 100° C.) of 2 to 20 cSt, a viscosity index of 60 to 150, a pour point of −18° C. to 12° C., and an aromatic content of 10 wt % or more, a black color of a color value of 8 to 10 according to the ASTM standards, a high sediment content, and may contain some moisture.

As used herein, the term "refined oil fraction" refers to an oil component resulting from a process in which waste lubricant undergoes centrifugal separation, atmospheric distillation, first vacuum distillation, second vacuum distillation, or a combination thereof. In an embodiment, the refined oil fraction is made by treating a waste lubricant sequentially to centrifugal separation, atmospheric distillation, and a first vacuum distillation. In another embodiment, the refined oil fraction is made by treating a waste lubricant sequentially to centrifugal separation, atmospheric distillation, a first vacuum distillation, and second vacuum distillation. The refined oil fraction has a reduced impurity content compared to the original waste lubricant. For example, the refined oil fraction may have a sulfur content of less than 1000 ppm, a nitrogen content of less than 500 ppm, and a chlorine content of less than 2000 ppm.

According to one embodiment of the present disclosure, there is provided a lube base oil manufacturing process utilizing a refined oil fraction obtained by refining a waste lubricant, and the process may include an operation of producing the refined oil fraction by refining a waste lubricant.

The operation of producing the refined oil fraction by recycling waste lubricant may include centrifugation, atmospheric distillation, first vacuum distillation, or second distillation of a waste lubricant, or a combination thereof.

Figure 1:
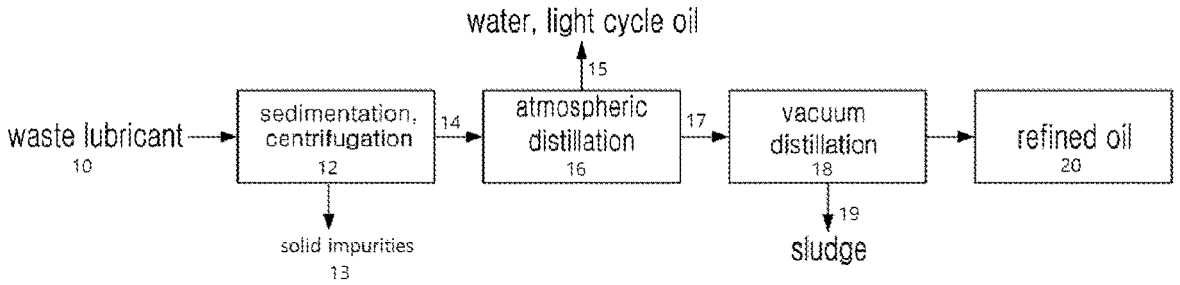
FIG. 1 is a flowchart illustrating a process of refining waste lubricant to prepare a refined oil fraction, according to an embodiment of the present disclosure.

Referring to FIG. 1, a refined oil fraction 20 is produced by a process which includes subjecting a waste lubricant 10 to a centrifugation operation 12 for separating and removing solid impurities 13 present in the waste lubricant 10 and producing a purified waste lubricant 14. The process may further include performing an atmospheric distillation 16 on the purified waste lubricant 14 for separating the purified waste lubricant in a plurality of fractions according to their boiling point and performing a first vacuum distillation 18 to a fraction 17 obtained from the atmospheric distillation operation having a boiling point of about 150° C. or higher. Sludge 19 is removed and refined oil 20 is collected. The refined oil fraction may have a boiling point of 300° C. to 550° C.

More specifically, the centrifugation process 12 is used to separate and remove solid impurities present in the waste lubricant by sedimentation, and may be performed at a rotation speed of about 100 rpm to 3000 rpm. Instead of the centrifugal separation, natural sedimentation may be used to remove the solid impurities. However, the centrifugal separation provides faster separation speed and improved performance.

After the high-density solid impurities which are not miscible with the waste lubricant are primarily removed by the centrifugal separation, the waste lubricant 14 undergoes atmospheric distillation 16 performed under atmospheric pressure. The atmospheric distillation may be performed at a temperature in a range of about 50° C. to 350° C. As the atmospheric distillation temperature increases, fractions in the waste lubricant are distilled and fractionated in order of lower boiling points. Among the fractions fractionated through the atmospheric distillation operation, a fraction 17 having a boiling point of about 150° C. or higher is collected to produce the refined oil fraction. In addition, water and light cycle oil 15 may also be separated. An oil fraction having a boiling point lower than 150° C. may be separated and used for other purposes, such as used as a fuel oil, rather than as a feedstock for subsequent lubricant base oil manufacturing processes.

The oil fraction collected in the atmospheric distillation 17 operation undergoes vacuum distillation 18. The vacuum distillation 18 may be performed for further fractionation of the oil fraction 17 obtained in the atmospheric distillation operation. In an embodiment, the vacuum distillation 18 may comprise first vacuum distillation and second vacuum distillation. When the distillation temperature is increased for the fractionation of the oil fraction under atmospheric pressure, oil fraction cracking may occur. For this reason, this operation may be performed in reduced pressure and mild temperature conditions. The first vacuum distillation may be performed at a pressure of 10 torr or less and a temperature of 150° C. to 350° C. During the first vacuum distillation operation 18, an oil fraction having a boiling point of 300° C. to 550° C. is collected, and the collected oil fraction is referred to as "vacuum ionic refined oil". The vacuum refined oil fraction has a specific gravity of about 0.8 to 1.0, a kinematic viscosity of about 4 to 6 cSt at a temperature of 100° C., a viscosity index (VI) of about 80 to 150, and a pour point of about −20° C. to 0° C. In addition, the vacuum refined oil has a sulfur content of about 200 to 1000 ppm, a nitrogen content of about 200 to 500 ppm, and a chlorine content of about 30 to 2000 ppm. That is, the refined oil fraction has a reduced impurity content compared to the waste lubricant. The vacuum refined oil exhibits a brown color with a color value of about 5 to 6 according to the ASTM standards. By the centrifugation and two-operation distillation, the vacuum refined oil has a reduced content of sediment and moisture compared to the original waste lubricant.

The vacuum refined oil obtained through the first vacuum refinement may be introduced into the second vacuum refinement operation. The second vacuum refinement operation may be used for removing any light cycle oils that may be present in the vacuum refined oil and which may have boiling points in a range of boiling points of solvents used in the subsequent operation. The second vacuum distillation may be performed at a pressure of 10 torr or less and a temperature of 150° C. to 350° C. The refined oil fraction obtained by the second vacuum distillation has a kinematic viscosity of 4.5 to 6 cSt at 100° C., a viscosity index of about 110 to 150, and a pour point of about-20° C. to −8° C. In addition, the refined oil fraction has a sulfur content of about 200 to 500 ppm, a nitrogen content of about 200 to 400 ppm, and a chlorine content of about 30 to 200 ppm. That is, the refined oil fraction has a reduced impurity content compared to the vacuum refined oil. The second vacuum distillation operation may remove oils with boiling points in a range of boiling points of solvents used in the subsequent solvent extraction operation, thereby ensuring that the purity of the solvent recovered after solvent extraction is high, and the impurity content of the refined oil used as a feedstock is reduced. In addition, the second vacuum distillation operation can preliminarily remove low boiling point oils that are not required for a base oil manufacturing process and reduce the amount of the feed introduced into the solvent extraction operation, thereby reducing process load.

The process includes an operation of pretreating the refined oil fraction. The pretreatment refers to an operation of additionally treating the refined oil fraction to minimize the influence of the refined oil on the process and catalyst by blending with unconverted oil before the refined oil fraction is introduced into the lube base oil manufacturing process. The pretreatment includes extracting the refined oil fraction through solvent extraction.

Figure 2:
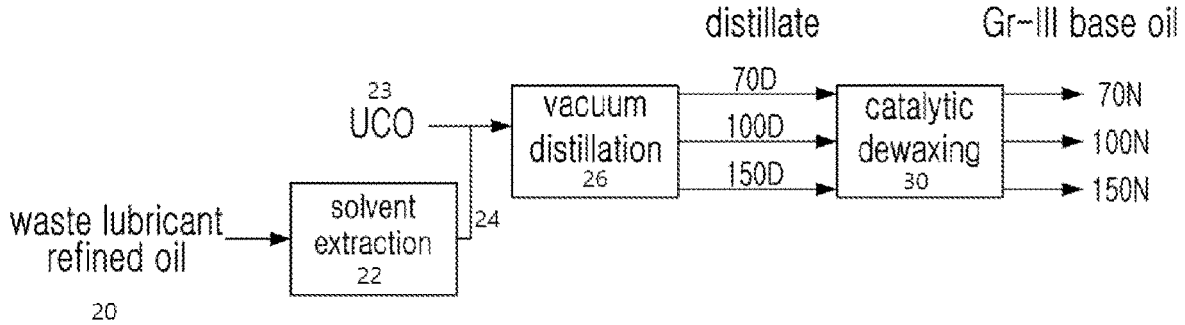
FIG. 2 is a process flow diagram according to an embodiment of the present disclosure.

Referring to FIG. 2, the solvent extraction 22 of the refined oil fraction 20 is an operation of blending the refined oil fraction and a solvent in a blending tank, an operation of allowing the mixture to be held stationary to reach phase separation, thereby obtaining a phase in which oil is a main component, and an operation of removing a phase containing a large amount of impurity. The solvent used for the solvent extraction 22 may be a solvent having a higher affinity for impurities than the oil components contained in the refined oil. In an embodiment, a solvent used for the solvent extraction may be selected from the group consisting of N-methyl-2-pyrrolidone, sulfolane, DMSO, furfural, phenol, acetone, and combinations thereof. The solvent may have high affinity to impurities and low affinity to the oil component in the refined oil fraction, so that the solvent is phase-separated from the oil component in the refined oil fraction. Any solvent may be used without limitation as long as it exhibits a different volatility in the subsequent solvent separation operation.

Referring to FIG. 2, the solvent extraction 22 of the refined oil 20 may be carried out at about 50° C. to 150° C., or about 55° C. to 120° C., or about 60° C. to 100° C. In addition, the solvent extraction of the refined oil may be carried out under a pressure of from atmospheric pressure to 5 $kg/cm^2$, or from 1 $kg/cm^2$ to 4 $kg/cm^2$, or from 2 $kg/cm^2$ to 3 $kg/cm^2$. The solvent extraction under the above-described conditions is effective in reducing the impurity content and especially the nitrogen content in the refined oil, and the reduction of the impurity content in the refined oil allows mild operating conditions in the subsequent process operations, thereby increasing the efficiency of the entire lube base oil manufacturing process.

In addition, the volume ratio of the solvent used in the solvent extraction operation with respect to the oil component contained in the refined oil fraction may be 1:1 to 10:1, or 2:1 to 8:1, or 2:1 to 7:1, or 2:1 to 6:1, or 2:1 to 5:1, or 3:1 to 8:1, or 3:1 to 7:1, or 3:1 to 6:1, or 4:1 to 8:1, 4:1 to 7:1, or 5:1 to 8:1. The volume ratio of the solvent used in the solvent extraction operation of the refined oil fraction to the oil component contained in the refined oil fraction may be in a range of 1:1 to 1.5:1. The above volume ratio is advantageous in terms of the balance between the level of impurity removal through the solvent extraction and the yield of the lube base oil subsequently produced from the pretreated refined oil fraction.

After the solvent extraction operation 22, the refined oil fraction has a specific gravity of 0.8 to 0.9, a kinematic viscosity at 100° C. in a range of 4 to 6 cSt, a viscosity index of 110 to 130, a pour point of −18° C. to −3° C., a sulfur content of less than 150 ppm, a nitrogen content of less than 100 ppm, and a chlorine content of less than 20 ppm.

Specifically, the refined oil fraction resulting from the solvent extraction operation, i.e., the pretreated refined oil 24, may contain less than 30 ppm of nitrogen, preferably less than 20 ppm, and more preferably less than 10 ppm. That is, the refined oil fraction 24 may have improved properties and a reduced impurity content by undergoing the solvent extraction, may exhibit a light brown color with a color value of about 2 to 4 according to the ASTM standards, and may have a reduced sediment content compared to the original refined oil fraction which has not yet undergone the solvent extraction.

The process may further include an operation of blending the unconverted oil 23 and the pretreated refined oil fraction 24. The blending operation may be performed before the vacuum distillation 26 and catalytic dewaxing 30 on the unconverted oil, after vacuum distillation and catalytic dewaxing on the unconverted oil, and between the vacuum distillation and the catalytic dewaxing. In addition, the process may include an operation of blending the unrefined oil fraction with the unconverted oil before the vacuum distillation and catalytic dewaxing operations for the unconverted oil. The details of the process of the embodiments of the present disclosure in each case are as follows but the embodiments are not limited thereto.

Model 1. Case of Blending Pretreated Refined Oil Fraction with Unconverted Oil Before Vacuum Distillation and Catalytic Dewaxing of Unconverted Oil Referring to FIG. 2, a refined oil fraction 24 having undergone solvent extraction, which is performed for pretreatment, is blended with unconverted oil 23, and then the blended oil undergoes vacuum distillation 26 and catalytic dewaxing 30. According to the process of Model 1, the pretreated refined oil fraction of waste lubricant is fractionated according to a boiling point distribution in the vacuum distillation operation, and may be distributed to the final products, which are Group III or higher lube base oils (70N, 100N, and 150N fractions in FIGS. 2-5).

Figure 3:
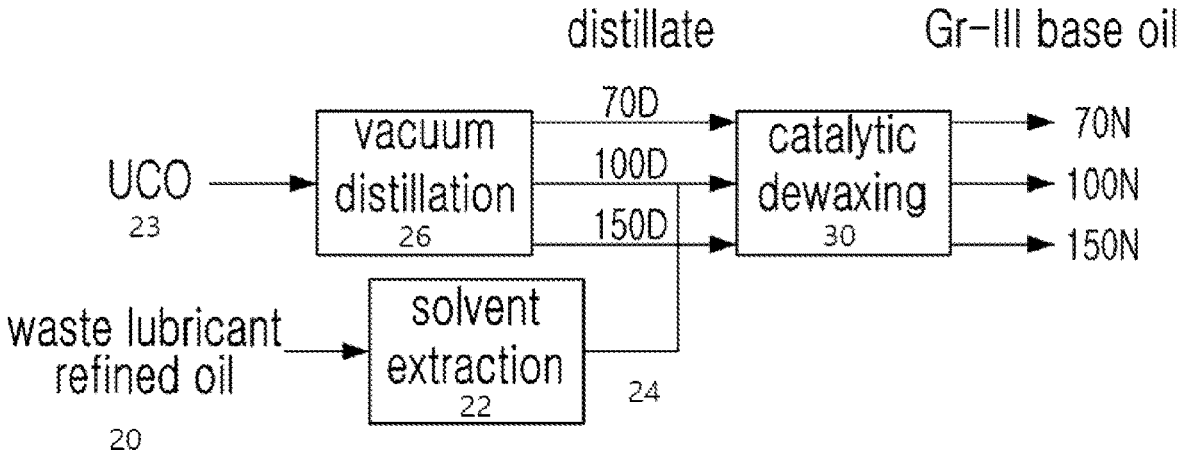
FIG. 3 is a process flow diagram according to an embodiment of the present disclosure.
Figure 4:
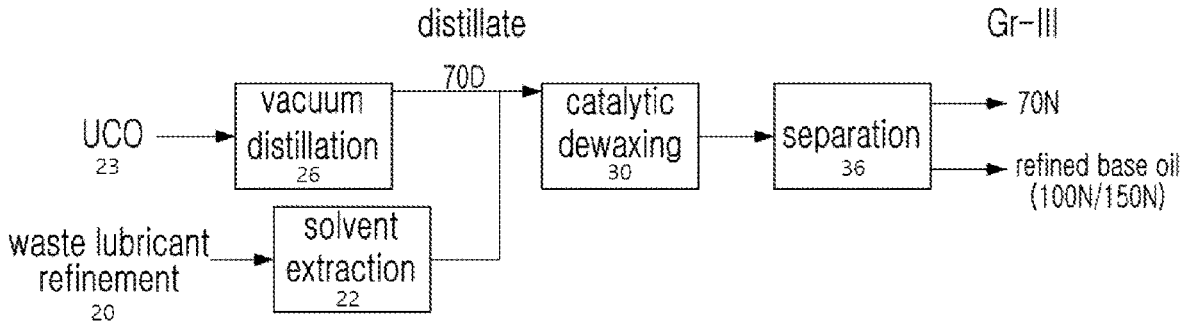
FIG. 4 is a process flow diagram according to an embodiment of the present disclosure.
Figure 5:
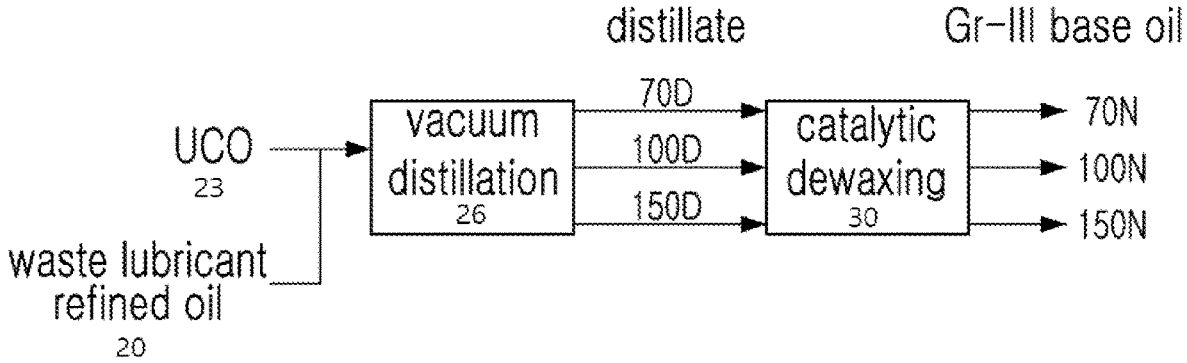
FIG. 5 is a process flow diagram according to an embodiment of the present disclosure.

Model 2. Case of Blending Pretreated Refined Oil Fraction with Unconverted Oil Between Vacuum Distillation and Catalytic Dewaxing of Unconverted Oil Referring to FIGS. 3 and 4, a refined oil fraction 24 having undergone solvent extraction, which is performed for pretreatment, may be blended with a fraction of the fractions of the unconverted oil fractionated by the vacuum distillation 26. For example, the pretreated refined oil fraction may be blended with the 70D distillate fraction resulting from the vacuum distillation fractionation (FIG. 4), or may be blended with the 100D and 150D distillate fractions resulting from the vacuum distillation fractionation 26 (FIG. 3). As described above, when the pretreated refined oil fraction of the waste lubricant is blended with each of the fractions obtained through the vacuum distillation fractionation, it is possible to prepare a lube base oil having a desired boiling point by blending the refined oil fraction with an unconverted oil fraction having a specific boiling point. In the operation of blending the refined oil fraction with each fraction of the unconverted oil and of subjecting each blended formulation to catalytic dewaxing, even though there is a problem in the treatment of any one blended raw material formulation, there is an advantage that the problematic raw material formulation does not negatively affect the lube base oil manufacturing process because the other blended raw material formulations can be used.

In the above-described process configuration, the amount of the pretreated refined oil fraction in the total raw material formulation may be in a range of about 1% to 10% by volume. The amount of the pretreated refined oil fraction with respect to the total raw material formulation may be preferably in a range of about 1.2% to 8% by volume, and more preferably in a range of about 1.5% to 5%. The amount of the pretreated refined oil fraction in the total raw material formulation may be most preferably in a range of about 2% to 4% by volume. The pretreated refined oil fraction contains almost no wax component. Therefore, as described above, the pour point is as low as-18° C. to −3° C. When the pretreated refined oil fraction is blended with unconverted oil having a high pour point of about 42° C., the fluidity of the blended raw material formulation is increased, so that the raw material formulation can be easily transported even at low temperatures. When the blending amount of the pretreated refined oil fraction is lower than 3% by volume, the effect of increasing the fluidity is not significant, so that the blended raw material formulation cannot be easily transported from one operation to another. When the blending amount of the pretreated refined oil fraction exceeds 10% by volume, the blended raw material formulation is not suitable as a raw material for producing a high-grade lube base oil due to impurities contained in the refined oil fraction and a low viscosity index.

As described above, the blended raw material formulation obtained by blending the pretreated refined oil fraction and the unconverted oil with a low impurity content also has a low impurity content, thereby reducing the burden on the catalyst in the subsequent dewaxing operation. The low impurity content of the raw material formulation has the advantage that the process temperature of the dewaxing operation can be lowered.

In Models 1 and 2, the blended raw material formulation prepared by blending the unconverted oil and the refined oil fraction has a specific gravity of 0.8 to 0.9, a kinematic viscosity (at 100° C.) of 3 to 8 cSt, a viscosity index of 120 to 140, a pour point of 12° C. to 45° C., a sulfur content of less than 20 ppm, a nitrogen content of less than 5 ppm, and a chlorine content of less than 1 ppm. That is, the blended raw material formulations of Models 1 and 2 are similar to Group III lube base oils in terms of properties except for the pour point. In addition, the blended raw material formulation exhibits a yellow color with a color value of about 0.5 to 1 according to the ASTM standards.

Model 3. Case of Blending Non-Pretreated Refined Oil Fraction with Unconverted Oil Before Vacuum Distillation and Catalytic Dewaxing of Unconverted Oil Referring to FIG. 5, a blended raw material formulation in which a non-pretreated refined oil fraction 20 and unconverted oil 23 are blended is introduced into a vacuum distillation operation 26 and thus fractionated according to boiling points, and each fraction is introduced into a catalytic dewaxing operation 30. Thus, lube base oils are obtained. In this way, when the refined oil fraction is blended with unconverted oil without pre-treatment of the refined oil fraction, there is an advantage in that the process can be simplified. However, to control the impurity content in the blended raw material formulation, the blending amount of the refined oil fraction needs to be lower than that in Models 1 and 2.

In the case of Model 3, since the refined oil fraction does not undergo a pretreatment operation such as solvent extraction, the impurity content of the blended raw material formulation in Model 3 is higher than those in Models 1 and 2. This is a process constraint of the overall advanced lube base oil manufacturing process. In Model 3, the blending amount of the refined oil fraction with respect to the unconverted oil is limited to 5% by volume or less.

In addition, the blended raw material of Model 3 has properties similar to the blended raw materials of Models 1 and 2, but has a sulfur content of 100 to 300 ppm, a nitrogen content of 50 to 100 ppm, and a chlorine content of 5 to 20 ppm. That is, the blended raw material of Model 3 exhibits a higher impurity content than that of each of Models 1 and 2.

The vacuum distillation operation for the unconverted oil may be performed prior to the catalytic dewaxing operation. In the case where the unconverted oil and the refined oil fraction are blended before the vacuum distillation operation, the vacuum distillation operation for the blended raw material may be performed prior to the catalytic dewaxing operation. Typically, the general process sequence is to fractionate and obtain a lube base oil having a desired boiling point by distilling the product resulting from the catalytic dewaxing under reduced pressure. However, in the process of the present disclosure, the vacuum distillation may be performed first, and only the fraction having a desired boiling point is catalytically dewaxed. Therefore, it is possible to produce only a product having a desired boiling point, to control the production volume of the product, and to reduce the process scale, resulting in reduction in the operating cost of the process.

The vacuum distillation operation for the unconverted oil may be performed under the same process conditions as the vacuum distillation of the waste lubricant in the operation of generating the refined oil fraction, whereby the unconverted oil or the blended raw material is fractionated according to the boiling point.

The catalytic dewaxing selectively isomerizes the wax component contained in the unconverted oil or the blended raw material to improve low-temperature properties (to ensure a low pour point) and to maintain a high viscosity index (VI). In the present invention, it is intended to achieve improvement in efficiency and yield through improvement of the catalyst used in the catalytic dewaxing process. The catalytic dewaxing operation may include a dewaxing reaction and a subsequent hydrofinishing reaction.

In general, the main reaction of catalytic dewaxing is to convert N-paraffin to iso-paraffin through an isomerization reaction to improve low-temperature properties, and it is reported that the catalyst used here is mainly a bi-functional catalyst. A bi-functional catalyst is composed of two active components: a metal active component (metal site) for hydrogenation/dehydrogenation reaction and a carrier (acid site) for skeletal isomerization using carbynium ions. A catalyst having a zeolite structure is generally composed of an aluminosilicate carrier and at least one metal selected from Group 8 metals and Group 6 metals.

The dewaxing catalyst used in the embodiments of the present disclosure includes a carrier having an acid site selected from molecular sieve, alumina, and silica-alumina, and one or more hydrogenating metals selected from elements of Groups 2, 6, 9 and 10 of the Periodic table. In particular, among the metals in Group 9 and Group 10 (i.e., Group VIII), Co, Ni, Pt, and Pd may be used, and among the metals in Group 6 (i.e., Group VIB), Mo and W may be used.

The types of carriers having acid sites include molecular sieves, alumina, silica-alumina, and the like. Among these, the molecular sieves refer to crystalline aluminosilicates (zeolite), SAPO, ALPO, and the like. A medium pore molecular sieve with a 10-membered oxygen ring, such as SAPO-11, SAPO-41, ZSM-11, ZSM-22, ZSM-23, ZSM-35, and ZSM-48 is used, and a large pore molecular sieve with a 12-membered oxygen ring may be used.

In particular, in the embodiments of the present disclosure, EU-2 zeolite having a controlled phase transition degree may be preferably used as the carrier. After pure zeolite is generated, the synthesis conditions are likely to change, or the synthesized zeolite crystal is likely to gradually transition to a more stable phase if the synthesis continues over a predetermined period time. This phenomenon is referred to as phase transformation of zeolite. It was confirmed that isomerization selection performance was improved according to the degree of phase transformation of the zeolite, and excellent performance was also exhibited in the catalytic dewaxing reaction using the same.

The lube base oil produced by the process described above may be a high-grade lube base oil having a grade of Group III or higher in the API classification described above. More specifically, the lube base oil has a viscosity index of 120 or more, preferably 120 to 140, 120 to 135, 120 to 130, 120 to 125, 125 to 140, 125 to 135, 125 to 130, 130 to 140, and 130 to 135, and the degree of saturation is 90% or more, preferably 91% or more, 92% or more, 93% or more, 94% or more, 95% or more, 96% or more, 97% or more, 98% or more, and 99% or more.

In addition, the lube base oil may contain almost no impurities since the content of each of the impurities such as sulfur, nitrogen, and chlorine is 1 ppm or less.

The lube base oil may have a Saybolt color value of 27 or greater, when measured by ASTM D 156. When the lube base oil has a Saybolt color value is 27 or greater, it is considered that this lube base oil is a lube base oil having stability corresponding to Water White grade. Water White grade lube base oils have a sulfur content of less than 1 ppm, a nitrogen content of less than 1 ppm, a saturation degree of 99% or more, and an aromatic content of less than 1%. These lube base oils are more stable than conventional API Group III lube base oils.

The lube base oil may exhibit a UV 260-350 nm absorbance of 2.5 or less and a UV 325 nm absorbance of 0.7 or less, as measured by ASTM D 2008. Here, the absorbance at a wavelength of 260 to 350 nm indicates that the test material contains a component having 3 or more aromatic rings, and the absorbance at a wavelength of 325 nm indicates that the test material contains a component having 3 to 7 aromatic rings. The lube base oil exhibits a low absorbance at these wavelengths. That is, the lube base oil has a low aromatic content, thereby having high stability.

The properties and impurity content of suitable oils in each operation of the process are shown in the table below.

TABLE 2

| | Waste lubricant | Refined fraction | Pretreated Refined oil fraction (Solvent extraction) | Blended raw material | Lube base oil |
|---|---|---|---|---|---|
| Specific gravity | 0.8 to 0.9 | 0.8 to 0.9 | 0.8 to 0.9 | 0.8 to 0.9 | 0.8 to 0.9 |
| Kinematic viscosity (at 100° C.), cSt | 2 to 20 | 4 to 6 | 4 to 6 | 3 to 8 | 3 to 8 |
| Viscosity index | 60 to 150 | 100 to 120 | 110 to 130 | 120 to 140 | 110 to 130 |
| Pour point | −18 to 12 | −18 to −3 | −18 to −3 | 12 to 45 | −39 to −12 |
| Sulfur, ppm | 1000 to 3000 | 200-1000 | 70 to 150 | 0 to 50 | 0 to 1 |
| Nitrogen, ppm | 500 to 2000 | 200 to 400 | 10 to 30 | 0 to 6 | 0 to 1 |
| Chlorine, ppm | 00 to 12000 | 30 to 2000 | 5 to 20 | 0 to 2 | 0 to 1 |
| Aromatic compound, wt % | 10% or more | 0 to 10 | 0 to 5 | 0 to 2 | 0 to 1 |

Hereinafter, examples are presented to aid understanding of the embodiments of the present disclosure. However, the following examples are provided only to facilitate easier understanding of the embodiments of the present disclosure, and the embodiments are not limited thereto.

Example

1. Measurement of Behavior of Lube Base Oil Produced by Process of Present Disclosure Waste lubricant having a sulfur content of about 2000 ppm, a nitrogen content of about 1500 ppm, and a chlorine content of about 1500 ppm was centrifuged at a speed of about 300 rpm, followed by atmospheric distillation, first vacuum distillation, and second vacuum distillation to obtain a refined oil fraction. The obtained refined oil fraction was extracted by solvent extraction, the treated refined oil fraction is blended with an unconverted oil as in Model 1 such that the blending ratio of the treated refined oil fraction with respect to the unconverted oil is 2.3% by volume. The resulting mixture underwent vacuum distillation and catalytic dewaxing to generate a lube base oil. Here, the atmospheric distillation was performed at a temperature of 50° C. to 350° C. and at atmospheric pressure. The process conditions of the first and second vacuum distillation processes are shown in Table 3 and 4 below.

TABLE 3

| Process conditions for first vacuum distillation | |
|---|---|
| Temperature | 100° C. to 350° C. |
| Pressure | 10 torr |

TABLE 4

| Process conditions for second vacuum distillation | |
|---|---|
| Temperature | 100° C. to 300° C. |
| Pressure | 10 torr |

The process conditions of the solvent extraction are shown in Table 5 below.

TABLE 5

| Process conditions for solvent extraction | |
|---|---|
| Temperature | 50° C. to 70° C. |
| Pressure | 1 to 2 kg/cm$^2$ |
| Volume ratio of solvent to oil components in refined oil | 1.5 to 2:1 |

In addition, the catalytic dewaxing is carried out at a temperature of 300° C. and a pressure of 150 kg/cm$^2$, in the presence of a hydrogenation catalyst containing EU-2 zeolite as a carrier. The lube base oils prepared by the above-described manufacturing process of Model 1 was measured for various properties, and as a result of the measurements, the lube base oil had a specific gravity of 0.84, a kinematic viscosity at 100° C. of 7.3 cSt, a viscosity index (VI) of 129, a kinematic viscosity of −33° C., a sulfur content of less than 1 ppm, a nitrogen content of less than 1 ppm, and a chlorine content of less than 1 ppm, and contained almost no impurities except for unavoidable trace amounts of impurities.

TABLE 6

| Properties of lube base oil manufactured by a process configured according to Model 1 of the present disclosure | | |
|---|---|---|
| Classification | Test method | Specification |
| Appearance | Visual | Bright & Clear |
| Saybolt color | ASTM D 156 | Min. +27 |
| Saturation % | ASTM D 7419 | Min. 99 |
| UV 260 to 250 nm | ASTM D 2008 | Max. 3.0 |
| UV 325 nm | ASTM D 2008 | Max. 1.0 |
| Viscosity index | ASTM D 2270 | Min. 120 |

It was found that the lube base oil had a viscosity index of at least 120 and a saturation degree of at least 95%, thus fulfilling the criteria of Group III lube base oils shown in Table 1 above. The lube base oil was bright and clear in color when visually evaluated by the eye and exhibited a Saybolt color value of 27 or greater as measured in accordance with ASTM D 156. That is, the lube base oil is a lube base oil having a water white grade, and the lube base oil has high thermal stability at high temperatures.

In addition, the lube base oil exhibits a low absorbance of up to 3.0 (up to 1.0 at a wavelength of 325 nm) when measured according to ASTM D 2008 for UV having a wavelength of 260 to 350 nm, and especially for UV having a wavelength of 325 nm. It was confirmed that the lube base oil had high stability against UV.

2. Evaluation of Lube Base Oil Production Yield with or without Blending with Refined Oil Fraction of Waste Lubricant A lube base oil was obtained under the same process conditions as in Example 1, except that the refined oil fraction of the waste lubricant was mixed with an unconverted oil. The results of comparing the yield of this case and the yield of Example 1 are shown in Table 7 below.

TABLE 7

| | Production yield of lube base oil (wt %) |
|---|---|
| Process conditions of Example 1 (blended with refined oil fraction) | 93-94% |
| Not blended with refined oil fraction | 93% |

As described above, when a lube base oil was produced using a raw material blended with unconverted oil as a feedstock, the lube base oil exhibited a yield equal to or slightly higher than that of the case where only unconverted oil was used as a feedstock. This is thought to be a result of the fact that unrefined oils contain about 15% N-paraffins, while refined oils do not contain any waxy components such as N-paraffins. As described above, when a certain amount of refined oil regenerated from waste lubricant is blended with unconverted oil, and the blended oil is used as a feedstock for the production of a lube base oil, the stability and yield of the final product lube base oil can be improved.

It is noted that although the invention has been described in reference to specific embodiments, the invention is not limited to the described embodiments, and that many variations, and modifications of the described embodiments as well as other embodiments may be envisioned by the skilled person in this art without departing from the scope of the invention. Furthermore, the embodiments may be combined to form additional embodiments.

What is claimed is:

1. A lube base oil manufacturing process utilizing refined oil regenerated from waste lubricant, the process comprising:

providing a refined oil fraction from waste lubricant;

pretreating the refined oil fraction, wherein the pretreated refined oil fraction has a nitrogen content of less than 30 ppm; and blending the pretreated refined oil fraction with unconverted oil before vacuum distillation and catalytic dewaxing of the unconverted oil, after the vacuum distillation and catalytic dewaxing of the unconverted oil, or between the vacuum distillation and the catalytic dewaxing, wherein the refined oil fraction has a boiling point of 300° C. to 550° C.

2. The process of claim 1, wherein the refined oil fraction is produced by a process comprising:

subjecting a waste lubricant to a centrifugation operation for separating and removing solid impurities present in the waste lubricant and producing a purified waste lubricant;

performing an atmospheric distillation on the purified waste lubricant for separating the purified waste lubricant in a plurality of fractions according to their boiling points; and performing a first vacuum distillation to a fraction obtained from the atmospheric distillation operation having a boiling point of about 150° C. or higher; and collecting the refined oil fraction having the boiling point of 300° C. to 550° C.

3. The process of claim 2, wherein an oil fraction obtained from the atmospheric distillation operation having a boiling point lower than 150° C. is used as a fuel oil.

4. The process of claim 1, wherein the pretreating of the refined oil fraction comprises performing solvent extraction on the refined oil fraction.

5. The process of claim 4, wherein a solvent used in the solvent extraction is selected from the group consisting of N-methyl-2-pyrrolidone, sulfolane, DMSO, furfural, phenol, acetone, and combinations thereof.

6. The process of claim 4, wherein the solvent extraction is carried out at a temperature in a range of 50° C. to 150° C. and at a pressure in a range of atmospheric pressure to 5 $kg/cm^2$.

7. The process of claim 4, wherein the solvent extraction is carried out in a condition in which a volume ratio of solvent to oil is in a range of 1:1 to 10:1.

8. The process of claim 1, wherein the vacuum distillation is performed before the catalytic dewaxing.

9. The process of claim 1, wherein the catalytic dewaxing is performed in the presence of a catalyst comprising an EU-2 zeolite carrier.

10. The process of claim 1, wherein an amount of the refined oil fraction blended with the unconverted oil is 1% or more and 10% or less by volume of the mixture in which the refined oil fraction and the unconverted oil are blended.

11. A lube base oil manufacturing process utilizing refined oil regenerated from waste lubricant, the process comprising:

subjecting a waste lubricant to a centrifugation operation for separating and removing solid impurities present in the waste lubricant and producing a purified waste lubricant;

performing an atmospheric distillation on the purified waste lubricant for separating the purified waste lubricant in a plurality of fractions according to their boiling points; and performing a first vacuum distillation to a fraction obtained from the atmospheric distillation operation having a boiling point of about 150° C. or higher;

collecting a refined oil fraction having a boiling point of 300° C. to 550° C.;

pretreating the refined oil fraction, wherein the pretreated refined oil fraction has a nitrogen content of less than 30 ppm;

blending the pretreated refined oil fraction with unconverted oil to form a mixture;

subjecting the mixture to vacuum distillation and catalytic dewaxing to produce lube base oils.

12. A lube base oil manufacturing process utilizing refined oil regenerated from waste lubricant, the process comprising:

providing a refined oil fraction from waste lubricant;

pretreating the refined oil fraction, wherein the pretreated refined oil fraction has a nitrogen content of less than 30 ppm; and blending the pretreated refined oil fraction with unconverted oil before vacuum distillation and catalytic dewaxing of the unconverted oil, after the vacuum distillation and catalytic dewaxing of the unconverted oil, or between the vacuum distillation and the catalytic dewaxing, wherein an amount of the refined oil fraction blended with the unconverted oil is 1% or more and 10% or less by volume of the mixture in which the refined oil fraction and the unconverted oil are blended.

13. A lube base oil manufactured by the process of claim 12, wherein the lube base oil has a viscosity index of 120 or more and a saturation degree of 90% or more.

14. The lube base oil of claim 13, wherein the lube base oil has a Saybolt color value of 27 or greater.

15. The lube base oil of claim 13, wherein the lube base oil has a saturation degree of 99% or more.

16. The lube base oil of claim 13, wherein the lube base oil has a sulfur content of less than 1 ppm, a nitrogen content of less than 1 ppm, and a chlorine content of less than 1 ppm.

* * * * *